US008162314B2

(12) United States Patent
Tanahashi et al.

(10) Patent No.: US 8,162,314 B2
(45) Date of Patent: Apr. 24, 2012

(54) IMAGE PRINTING APPARATUS

(75) Inventors: Naokazu Tanahashi, Nagoya (JP); Shingo Ito, Kasugai (JP); Shota Iijima, Nagoya (JP); Yasuhira Ota, Yatomi (JP); Iwane Sano, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/017,884

(22) Filed: Jan. 31, 2011

(65) Prior Publication Data

US 2011/0187040 A1 Aug. 4, 2011

(30) Foreign Application Priority Data

Jan. 29, 2010 (JP) ..... 2010-019498

(51) Int. Cl.
*B65H 5/00* (2006.01)
*B65H 5/06* (2006.01)
*B65H 85/00* (2006.01)

(52) U.S. Cl. ..... 271/264; 271/3.2; 271/273

(58) Field of Classification Search ..... 271/272, 271/264, 3.14, 3.18, 3.19, 273, 3.2; 347/101, 347/104

See application file for complete search history.

(56) References Cited

U.S. PATENT DOCUMENTS

| | | | | |
|---|---|---|---|---|
| 7,431,278 | B2 * | 10/2008 | Hiraki et al. | 271/3.14 |
| 7,748,710 | B2 * | 7/2010 | Terada | 271/272 |
| 7,887,044 | B2 * | 2/2011 | Uchino et al. | 271/121 |
| 8,016,410 | B2 * | 9/2011 | Sugiyama et al. | 347/104 |
| 8,020,986 | B2 * | 9/2011 | Tanahashi et al. | 347/104 |
| 8,038,248 | B2 * | 10/2011 | Uchino et al. | 347/16 |
| 2003/0081100 | A1 * | 5/2003 | Rasmussen et al. | 347/104 |
| 2006/0038847 | A1 | 2/2006 | Yanagi et al. | |

FOREIGN PATENT DOCUMENTS

JP 2006-056644 A 3/2006

* cited by examiner

*Primary Examiner* — Kaitlin S Joerger
*Assistant Examiner* — Patrick Cicchino
(74) *Attorney, Agent, or Firm* — Baker Botts L.L.P.

(57) ABSTRACT

An image printing apparatus includes a printing unit and a supporting member opposing the printing unit and having a supporting surface for supporting the printing medium. The image printing apparatus further includes a first pair of rollers disposed upstream of the printing unit, a second pair of rollers and a third pair of rollers which are disposed downstream of the printing unit. The image printing apparatus further includes a guide member disposed between the second pair of rollers and the third pair of rollers. The guide member includes a guide portion which guides the printing medium transported by the second pair of rollers. The guide member is configured to pivot between a slanting position and a laying position.

8 Claims, 6 Drawing Sheets

IMAGE PRINTING APPARATUS

CROSS REFERENCE TO RELATED APPLICATION

The present application claims priority from Japanese Patent Application No. 2010-019498, filed on Jan. 29, 2010, the disclosure of which is incorporated herein by reference in its entirely.

BACKGROUND

1. Technical Field

The present invention relates to an image printing apparatus which is suitable for printing an image on a rigid object.

2. Description of the Related Art

An image printing apparatus which has a first platen opposing a printing unit and a second platen downstream of the first platen is known. The image printing apparatus has a first pair of rollers upstream of the first platen, a second and third pair of rollers downstream of the first platen. The second platen is disposed downstream of the second pair of rollers and upstream of the third pair of rollers. Although the image printing apparatus can execute printing on a normal printing sheet and on a thick printing sheet, the image printing apparatus may not suitable for printing on a rigid object such as CD-ROM or DVD-ROM because positional relations among the second and third pair of rollers and the second platen may fail to receive the rigid object.

SUMMARY

A need has arisen to provide an image printing apparatus which may suitable for executing printing on a rigid object. According to an embodiment of the present invention, an image printing apparatus comprises a printing unit configured to print an image on a printing medium and a supporting member opposing the printing unit and having a supporting surface for supporting the printing medium. The image printing apparatus comprises a first pair of rollers, a second pair of rollers, a third pair of rollers and a guide member.

The first pair of rollers is configured to nip and transport the printing medium therebetween and disposed upstream of the printing unit in a transporting direction of the printing medium. The first pair of rollers includes a first upper roller and a first lower roller. A rotation axis of the first upper roller is disposed downstream relative to a rotation axis of the first lower roller in the transporting direction. A height of a nip position of the first pair of rollers is greater than a height of the supporting surface of the supporting member. The second pair of rollers is configured to nip and transport the printing medium therebetween and disposed downstream of the printing unit in the transporting direction. A height of a nip position of the second pair of rollers is greater than a height of the supporting surface of the supporting member. The second pair of rollers is configured to contact with and separate from each other. The third pair of rollers is configured to nip and transport the printing medium therebetween and disposed downstream of the second pair of rollers in the transporting direction. A height of a nip position of the third pair of rollers is greater than the height of the nip position of the second pair of rollers. The third pair of rollers is configured to contact with and separate from each other.

The guide member is disposed between the second pair of rollers and the third pair of rollers. The guide member includes a guide portion which guides the printing medium transported by the second pair of rollers. The guide member is configured to pivot between (a) a slanting position in which a height of a downstream end of the guide portion is greater than the height of the nip position of the second pair of rollers and is smaller than the height of the nip position of the third pair of rollers and (b) a laying position in which the height of the downstream end of the guide portion is same with the height of the nip position of the second pair of rollers.

BRIEF DESCRIPTION OF THE DRAWINGS

For a more complete understanding of the present invention, the needs satisfied thereby, and the features and advantages thereof, reference now is made to the following descriptions taken in connection with the accompanying drawings wherein.

DESCRIPTION OF PREFERRED EMBODIMENTS

Figure 1:
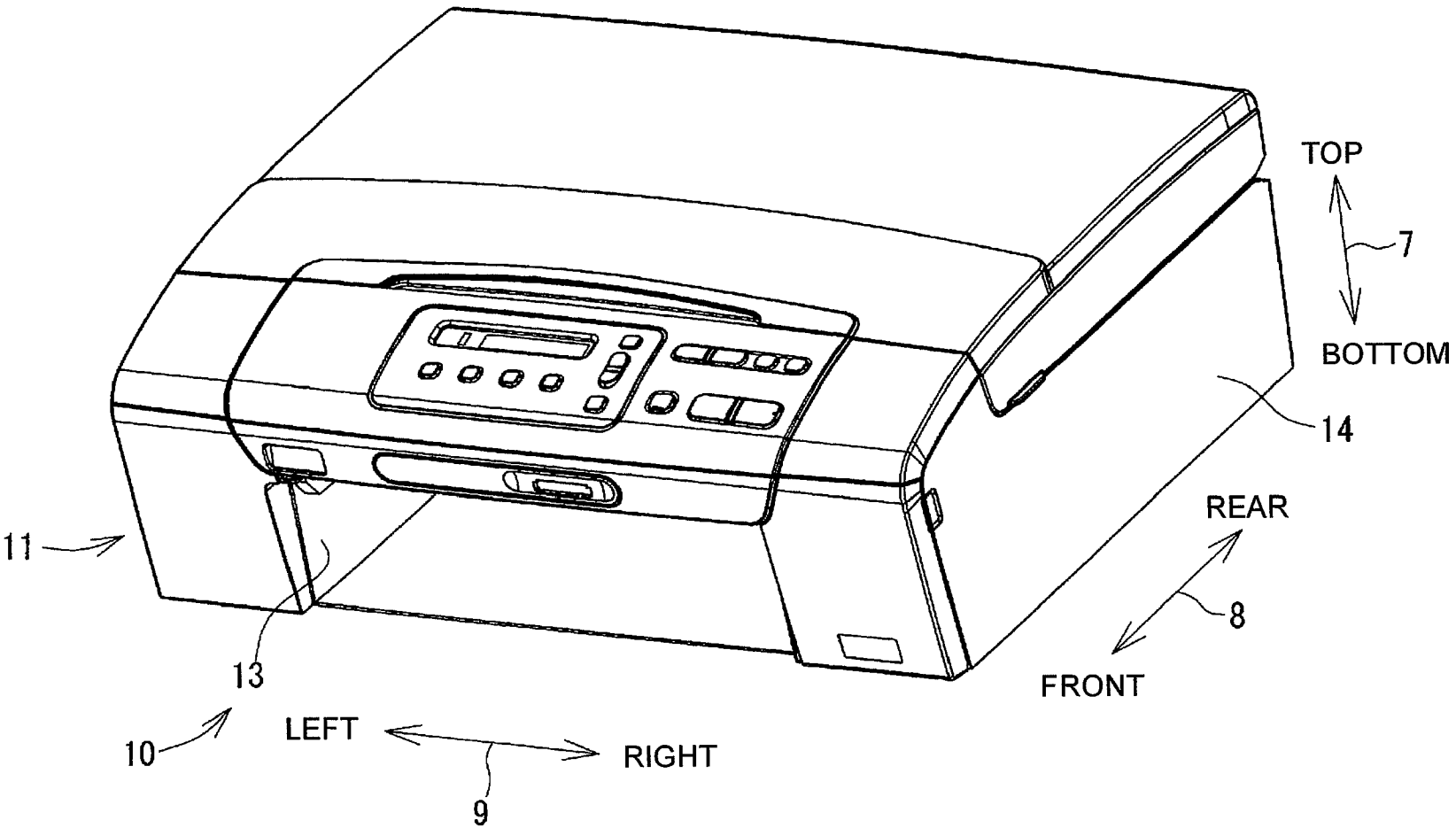
FIG. 1 is an appearance perspective view of a multifunctional peripheral.

Embodiments of the invention and their features and advantages may be understood by referring to FIGS. 1-6, like numerals being used for like corresponding parts in the various drawings. In the description given below, a configuration an example of an image printing apparatus in brief first, and then characteristic portions of the embodiments will be described in detail.

In the following description, a vertical direction 7 is defined with reference to a state in which a multifunction peripheral 10 is installed to be ready to use (the state in FIG. 1), a fore-and-aft direction 8 is defined by assuming a side having an opening 13 as a near side (front), and a lateral direction 9 is defined by viewing the multifunction peripheral 10 from the near side (front).

[Multifunctional Peripheral 10]

As shown in FIG. 1, the multifunctional peripheral 10 as an example of an image printing apparatus is formed generally into a thin parallelepiped shape, and includes a printer unit 11 of an ink-jet printing system disposed in a lower portion thereof. The multifunctional peripheral 10 has a variety of functions such as a facsimile function and a printing function. Whether a function other than the printing function is provided or not is arbitrary.

The printer unit 11 has a housing 14 formed with the opening 13 in the front, and allows insertion and removal of a paper feed tray 20 and a paper discharge tray 21 (see FIG. 2) in the fore-and-aft direction through the opening 13. The paper feed tray 20 is configured to accommodate printing papers (an example of a printing medium) of desired sizes. The paper discharge tray 21 is supported by the paper feed tray 20 and is arranged above the paper feed tray 20. The paper feed tray 20 and the paper discharge tray 21 are mounted one on top of another in the multifunctional peripheral 10.

[Printer Unit 11]

Figure 2:
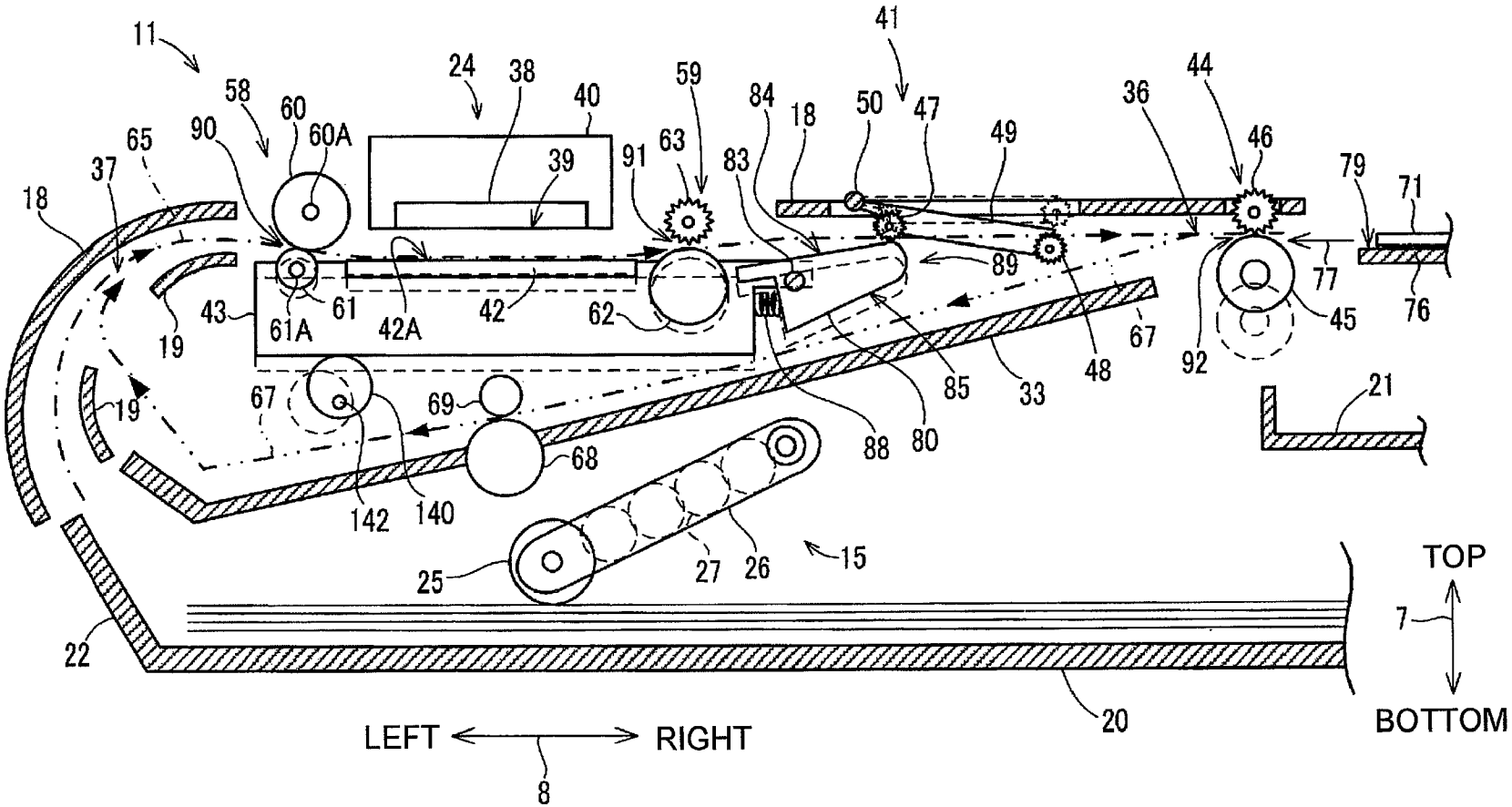
FIG. 2 is a vertical cross-sectional view diagrammatically showing an internal structure of a printer unit.

As shown in FIG. 2, the printer unit 11 includes a paper feeding unit 15 configured to pick up and feed the printing paper from the paper feed tray 20, and a printing unit 24 (an example of a printing unit). The printing unit may includes an ink-jet system configured to discharge ink droplets onto the fed printing paper for printing an image on the printing paper.

The printer unit 11 prints images on the printing paper on the basis of printing data or the like received from an external apparatus. The multifunctional peripheral 10 has a function to print images on a rigid object such as CD-ROM or DVD-ROM by the printing unit 24. This function will be described later.

[First Transporting Path 65]

A separation inclined panel 22 is disposed in the back of the paper feed tray 20 mounted on the multifunctional peripheral 10. The separation inclined panel 22 extends rearward and obliquely upward at a rear end portion of the paper feed tray 20 across the lateral direction 9 (the direction vertical to a paper plane in FIG. 2). The separation inclined panel 22 separates and guides the printing paper fed from the paper feed tray 20 upward.

A first transporting path 65 (an example of a first transporting path) is formed above the separation inclined panel 22. The first transporting path 65 extends from the back side to the front side of the multifunctional peripheral 10 by being curved from above the separation inclined panel 22 upward and then forward of the multifunctional peripheral 10, passing through a nip position of a first pair of rollers 58, the underside of the printing unit 24, and the nip position of a second pair of rollers 59, and then reaching the paper discharge tray 21. The printing paper is guided through the first transporting path 65 in the direction of transport (the direction indicated by an alternate long and two short dashes line with an arrow in FIG. 2, which corresponds to the direction of transport). The first transporting path 65 is divided by an outer guide member 18 and an inner guide member 19 opposing to each other with a predetermined distance disposed therebetween.

[Paper Feeding Unit 15]

A paper feed roller 25 is disposed above the paper feed tray 20. The paper feed roller 25 is supported via a shaft at a front end of a paper feed arm 26 which moves upward and downward so as to come into and out of contact with the paper feed tray 20. The paper feed roller 25 is rotated by a drive force from a paper feed motor (not shown) transmitted by a drive transmitting mechanism 27 including a plurality of gears engaging with each other. The paper feed roller 25 supplies the printing papers stacked on the paper feed tray 20 one by one to the first transporting path 65.

[Printing Unit 24]

The printing unit 24 includes a carriage 40 which includes a printhead 38 mounted thereon and moves reciprocally in the primary scanning direction (the direction vertical to the paper plane in FIG. 2). The printhead 38 receives a supply of ink from an ink cartridge (not shown). The printhead 38 discharges ink as minute ink droplets from nozzles 39 disposed on a lower surface thereof. The printhead 38 is moved with respect to the printing paper by the reciprocating movement of the carriage 40 in the primary scanning direction, so that the image is printed on the printing paper transported on a platen 42 disposed so as to oppose the printing unit 24 below the printing unit 24.

The platen 42 supports the printing paper and defines a distance between the printing paper and the printing unit 24. The platen 42 is supported by a supporting member 43, which is movable as described later, and constitutes a part of the supporting member 43. In other words, an upper surface 42A of the platen 42 as a surface where the printing medium is supported is an example of a supporting surface. With the configuration as described above, the supporting member 43 is disposed in the first transporting path 65 on the downside of the printing unit 24 so as to oppose thereto, and has a supporting surface which supports the printing medium.

[First Pair of Rollers 58, Second Pair of Rollers 59, and Third Pair of Rollers 44]

Disposed on the upstream side of the printing unit 24 in the direction of transport is the first pair of rollers 58 made up of a first transporting roller 60 (an example of a first upper roller) and a pinch roller 61 (an example of a first lower roller). The pinch roller 61 is press contact with a roller surface of the first transporting roller 60 by a resilient member such as a spring, not shown. The first pair of rollers 58 nips the transported printing paper and feed the same onto the platen 42. The first transporting roller 60 as the upper roller is arranged so that a center axis 60A is situated forward (downstream side in the transporting direction of the printing paper) of a center axis 61A of the pinch roller 61 as the lower roller. Accordingly, the printing paper is transported obliquely downward and is pressed against the platen 42.

Disposed on the downstream side of the printing unit 24 in the direction of transport is the second pair of rollers 59 made up of a second transporting roller 62 (an example of a second lower roller) and a spur roller 63 (an example of a second upper roller). In the same manner as the pinch roller 61, the spur roller 63 is brought into press contact with a roller surface of the second transporting roller 62. The second pair of rollers 59 nips the printing paper transported from the printing unit 24 and transports the same to the downstream side.

Disposed on the downstream side of the second pair of rollers 59 in the direction of transport is a third pair of rollers 44 made up of a third transporting roller 45 (an example of a third lower roller) and a spur roller 46 (an example of a third upper roller). In the same manner as the pinch roller 61, the spur roller 46 is brought into press contact with a roller surface of the third transporting roller 45. The third pair of rollers 44 nips the printing paper transported from the second pair of rollers 59 and transports the same to a paper discharge tray 21 side or to a second transporting path 67 described later (an example of a second transporting path).

The respective pair of rollers 58, 59, and 44 are arranged so as to satisfy a positional relationship in the vertical direction 7 as described below. In other words, nip positions 90 and 91 of the printing medium such as the printing papers by the first pair of rollers 58 and the second pair of rollers 59, respectively, are positioned above the upper surface 42A of the platen 42. In contrast, a nip position 92 of the printing medium such as the printing paper by the third pair of rollers 44 is positioned above the nip position 91 where the second pair of rollers 59 nips the printing medium.

In this embodiment, the first transporting roller 60, the spur roller 63, and the spur roller 46 which are positioned on the upper side from among the respective pair of rollers 58, 59 and 44 are rotatably supported by a frame (not shown) or the like of the printer unit 11. The pinch roller 61 and the second transporting roller 62 which are positioned on the lower side are rotatably supported by the supporting member 43, and the third transporting roller 45 is rotatably supported by a separate supporting member (not shown) from the supporting member 43.

The first transporting roller 60, the second transporting roller 62, and the third transporting roller 45 are rotated by a rotational drive force transmitted from a transporting motor (not shown) via a drive transmission mechanism (not shown). The drive transmission mechanism is made up of a planetary gear or the like, and is configured to rotate the respective rollers 60, 62, and 45 so as to transport the printing medium in the direction of transport when the transporting motor is rotated in one of the normal direction and the reverse direction (normal direction in this embodiment) and to transport the printing medium in the direction opposite from the direction of transport when the transporting motor is rotated in the other one of the normal direction and the reverse direction (reverse direction in this embodiment).

[Position Change of Pair of Rollers 58, 59, and 44]

The first pair of rollers 58, the second pair of rollers 59, and the third pair of rollers 44 are able to change their positions between a contact position in which the pair of rollers come into contact with each other and a separated position in which the pair of rollers are separated from each other.

The respective pair of rollers 58, 59, 44, being in the contact position, are capable of nipping the printing paper therebetween, and transport the printing paper along the first transporting path 65. When the first pair of rollers 58 and the second pair of rollers 59 are in the separated position, a distance between the pair of rollers of the respective pair of rollers is a suitable distance for nipping a media tray 71 (an example of a tray), described later. A distance between the pair of rollers when the third pair of rollers 44 takes the separated position is larger than the distance between the pair of rollers when the first pair of rollers 58 and the second pair of rollers 59 take the separated position.

In this embodiment, the pinch roller 61, the second transporting roller 62, and the third transporting roller 45, which are lower rollers of the first pair of rollers 58, the second pair of rollers 59, and the third pair of rollers 44 move downward, so that the respective pair of rollers 58, 59, and 44 change their positions from the contact position to the separated position.

In other words, when the printing paper is transported along the first transporting path 65, the pinch roller 61, the second transporting roller 62, and the third transporting roller 45 come into contact with the first transporting roller 60, the spur roller 63, and the spur roller 46, which are upper rollers, at the respective nip positions 90, 91, and 92 as indicated by solid lines in FIG. 2 and take positions which allow nipping of the printing paper therebetween. The position of the second transporting roller 62 at this time corresponds to a contacting position. The position of the third transporting roller 45 at this time corresponds to a further contacting position. In contrast, when the media tray 71 is transported along the first transporting path 65, the pinch roller 61, the second transporting roller 62, and the third transporting roller 45 move further downward from the positions being in abutment with the upper rollers as indicated by broken lines in FIG. 2. At this time, the pinch roller 61 and the second transporting roller 62 move downward by an amount corresponding to a thickness of the media tray 71 to take positions which allow nipping of the media tray 71 therebetween. The third transporting roller 45 takes a position moved significantly downward than the thickness of the media tray 71. The position of the second transporting roller 62 at this time corresponds to a separate position. The position of the third transporting roller 45 at this time corresponds to a further separate position.

The platen 42 is also movable downward. When the platen 42 does not move downward, a distance between the platen 42 and the printing unit 24 is a distance which allows the printing paper to pass under the printing unit 24. In other words, the platen 42 is able to support the printing paper when it is not moved downward. In contrast, when the platen 42 is moved downward, the distance is as large as allowing the media tray 71 to pass under the printing unit 24. In other words, the platen 42 is able to support the media tray 71 when it is moved downward.

The downward movement of the pinch roller 61, the second transporting roller 62, and the platen 42 is achieved, for example, by an eccentric cam 140 and the supporting member 43 disposed downward of the pinch roller 61, the second transporting roller 62, and the platen 42. The eccentric cam 140 is rotatably supported by a frame (not shown) of the printer unit 11 with the lateral direction 9 as a direction of an axial line thereof. The eccentric cam 140 is a disk whose radius from a shaft 142 periodically changes. The supporting member 43 is supported so as to be placed on the eccentric cam 140 and is movable in the vertical direction 7.

In this embodiment, the eccentric cam 140 is rotated by a drive force transmitted from a cam motor, not shown. When the eccentric cam 140 is rotated, a peripheral surface thereof is slid with respect to the supporting member 43. Since the radius from the shaft 142 to the peripheral surface of the eccentric cam 140 periodically changes, the supporting member 43 moves in the vertical direction 7 accordingly. In association with a movement of a third guide member 141 in the vertical direction 7, the pinch roller 61, the second transporting roller 62, and the platen 42 move in the vertical direction 7.

From the configuration as described above, the supporting member 43 is movable to change in position between an upper position which allows passage of the printing paper between the supporting member 43 and the printing unit 24, and a lower position lower than the upper position and allowing passage of the media tray 71 between the supporting member 43 and the printing unit 24.

The downward movement of the third transporting roller 45 is achieved, for example, by a supporting member (not shown) disposed downward of the third transporting roller 45 and different from the supporting member 43 which supports the third transporting roller 45, and an eccentric cam (not shown) supporting the supporting member and different from the eccentric cam 140. A method of moving the third transporting roller 45 is the same as the movement of the platen 42 or the like as described above. However, a diameter and an axial position of the eccentric cam are determined so that a distance of downward movement of the third transporting roller 45 becomes larger than a distance of movement of other rollers 61 and 62 or the platen 42. For example, the diameter of the eccentric cam which is used to move the third transporting roller 45 is larger than that of the eccentric cam 140.

The multifunctional peripheral 10 may have a configuration in which the distance between the platen 42 and the printing unit 24 can be changed by upward movement of the printing unit 24 instead of the downward movement of the platen 42. The position change of the respective pair of rollers 58, 59, and 44 is not limited to the method on the basis of the downward movements of the lower rollers 61, 62, and 45. For example, the position change may be performed by the upward movement of the upper rollers 60, 63, and 46.

[Path Switching Unit 41]

A path switching unit 41 (an example of a path switching unit) is disposed on the downstream side of the second pair of rollers 59 in the direction of transport, and on the upstream side of the third pair of rollers 44 in the direction of transport. The path switching unit 41 is made up of a supporting shaft 50, a flap 49, an auxiliary roller 47, and an auxiliary roller 48.

A branched port 36 is formed on the downstream side of the path switching unit 41 and on the upstream side of the third pair of rollers 44 in the direction of transport. When images are printed on both sides of a printing paper, the printing paper transported through the first transporting path 65 is transported toward the second transporting path 67, described later, extending downward from the branched port 36 after having switched back on the downstream side of the branched port 36.

The supporting shaft 50 extending in the vertical direction with respect to the paper plane in FIG. 2 (the lateral direction 9 in FIG. 1) is provided on the outer guide member 18 which constitutes an upper guide surface of the first transporting path 65. The flap 49 extends from the supporting shaft 50 in the downstream side generally in the direction of transport. The flap 49 is rotatably supported by the supporting shaft 50. In other words, the path switching unit 41 is rotatable about a side proximity to the printing unit 24 as an axis. The auxiliary roller 47 and the auxiliary roller 48 formed into a spur shape are supported by the flap 49 via shafts.

The path switching unit 41 is configured so as to be capable of changing the position, and rotates between an retracting position where a lower end of the auxiliary roller 48 is situated upward of the branched port 36 (a position indicated by a broken line in FIG. 2) and a protruding position in which the lower end of the auxiliary roller 48 enters downward of the branched port 36 (a position indicated by a solid line in FIG. 2).

The path switching unit 41 is maintained in the protruding position by being rotated downward by its own weight in the normal state. In this state, when a leading end of the printing paper passed underside of the printing unit 24 reaches the path switching unit 41, the path switching unit 41 is pressed against the upper surface of the printing paper, and hence is changed in position from the protruding position to the retracting position. In this state, the printing paper transported continuously is held by the third pair of rollers 44. Since the third transporting roller 45 is rotated in the normal direction in a state that the path switching unit 41 is maintained in the retracting position, the printing paper is transported toward the paper discharge tray 21. When a rear end portion of the printing paper reaches a prescribed position, which is an upstream side of the auxiliary roller 48, a force of the path switching unit 41 to rotate toward the protruding position by its own weight becomes stronger than a force of the printing paper pushing the path switching unit 41 upward. Accordingly, the position of the path switching unit 41 is changed from the retracting position to the protruding position. Therefore, the rear end portion of the printing paper is pressed downward by the auxiliary roller 48, and is directed toward the second transporting path 67.

When a one-side printing is performed, the third transporting roller 45 maintains the normal rotation, so that the third pair of rollers 44 discharges the printing paper to the paper discharge tray 21. In contrast, when a double-sided printing is performed, the third transporting roller 45 is switched from the normal rotation to the reverse rotation in a state in which the rear end portion of the printing paper is directed toward the second transporting path 67. Accordingly, the third pair of rollers 44 can switch back the printing paper to the second transporting path 67.

[Second Transporting Path 67]

The second transporting path 67 is branched at the branched port 36 from the first transporting path 65, passes underside of the supporting member 43 and upper side of the paper feed arm 26, and joins the first transporting path 65 at a meeting point 37 on the upstream side of the printing unit 24 in the direction of transport. The printing paper is transported through the second transporting path 67 in the direction from the branched port 36 to the meeting point 37.

The second transporting path 67 is divided by a lower inclined guide member 33 and the supporting member 43. The lower inclined guide member 33 is mounted on a frame of the printer unit 11, and includes an inclined surface inclining from the branched port 36 rearward and obliquely downward.

The second transporting path 67 is provided with a fourth transporting roller 68 and a spur roller 69. The spur roller 69 is brought into press-contact with a roller surface of the fourth transporting roller 68 by its own weight, a spring or the like. The fourth transporting roller 68 is rotated by the rotating force transmitted from the transporting motor, and transports the printing paper in the direction from the branched port 36 toward the meeting point 37.

[Media Tray 71]

As described above, the multifunctional peripheral 10 has a function to print images on disc surfaces of printing media such as CD-ROM or DVD-ROM. When printing the image on the disk surface of the recording medium, the recording medium is placed on the media tray 71. The media tray 71 is inserted from the opening 13 in the direction indicated by an arrow 77, which is the direction opposite from the direction of transport, along the first transporting path 65, while being placed on a tray guide 76, described later.

Figure 3B:
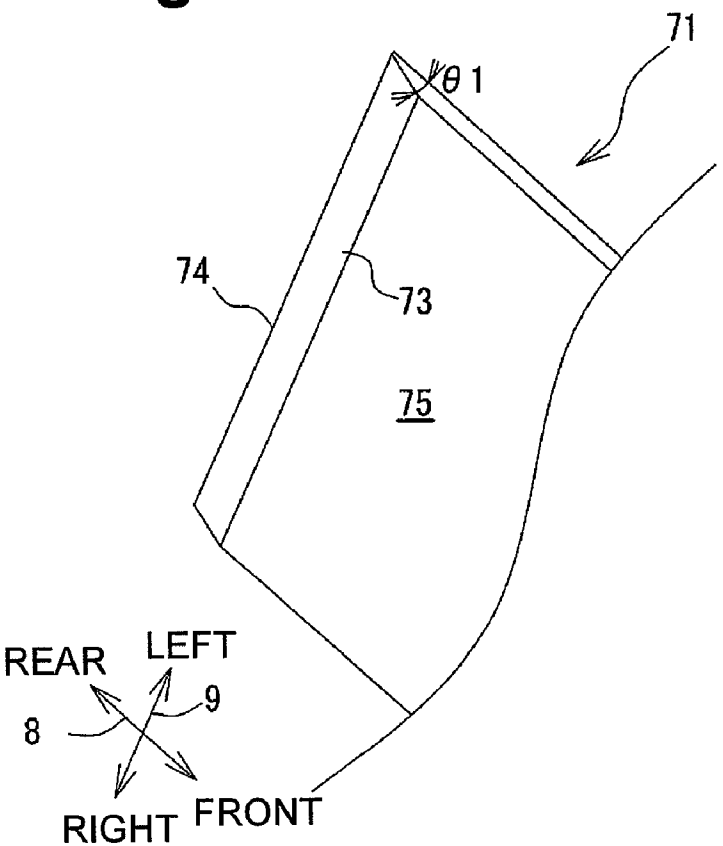
FIG. 3B is a perspective view of the media tray showing a portion in the vicinity of a leading end on a lower surface side.
Figure 3A:
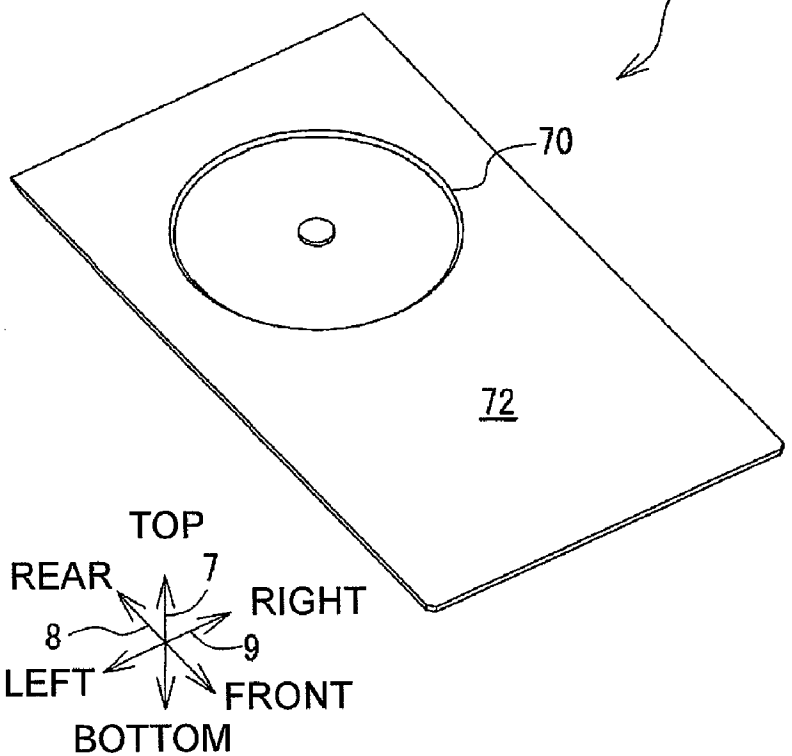
FIG. 3A is a perspective view of a media tray showing an upper surface side.

As shown in FIG. 3A, the media tray 71 is formed of resin and has a thickness in the vertical direction 7 of several millimeters (for example, 2 mm to 3 mm). The media tray 71 has a length in the direction of transport (the fore-and-aft direction 8) and a length in the width direction (the lateral direction 9) longer than the thickness (the vertical direction 7), and the length in the direction of transport (the fore-and-aft direction 8) is longer than the length in the width direction (the lateral direction 9). In other words, the media tray 71 is formed of a resin plate in a thin parallelepiped shape. An upper surface 72 of the media tray 71 is provided with a media placing portion 70, which is a circular depression for allowing a rigid object such as a CD-ROM or a DVD-ROM to be placed therein.

As shown in FIG. 3B, a leading end surface 73 which constitutes part of a lower surface 75 of the media tray 71 has an inclination of a predetermined angle θ1 from a leading end 74 of the media tray 71 to the lower surface 75 of the media tray 71. In other words, the leading end surface 73 of the media tray 71 faces obliquely downward. In contrast, the thickness of the media tray 71 is increased gradually as it goes forward from the leading end 74. The shape of a leading end portion of the media tray 71 as described above is an example of a guide portion.

As shown in FIG. 2, the tray guide 76 is disposed on the downstream side of the third pair of rollers 44 in the direction of transport of the printing paper. The tray guide 76 includes a bottom plate 78 which allows placement of the media tray 71 on an upper surface 79 (which corresponds to a guide surface), a right guide plate (not shown), and a left guide plate (not shown). The right guide plate and the left guide plate extend from the upper surface of the bottom plate 78 at both end portions of the bottom plate 78 in the lateral direction 9 and arranged along the direction of insertion of the media tray 71. A distance between the right guide plate and the left guide plate is the same as or slightly larger than the length of the media tray 71 in the width direction (lateral direction 9). Accordingly, the media tray 71 is not displaced in the lateral direction 9 when the media tray 71 is inserted from the opening 13 while being placed on the upper surface 79 of the bottom plate 78. From the configuration as described above, the tray guide 76 guides the insertion of the media tray 71 into the first transporting path 65.

The tray guide 76 is disposed above the paper discharge tray 21. A position of the upper surface 79 of the tray guide 76 in the vertical direction 7 is disposed on the downside of a distal end portion 89, which is the distal end side of a guide member 80 in a slanting position, described below. Specifically, the upper surface 79 of the tray guide 76 is disposed on the downside of a position of the guide member 80, which comes into abutment with the lower surface of the inserted media tray 71, that is, an uppermost position of an upper surface 84 of the guide member 80.

[Guide Member 80]

As shown in FIG. 2, the guide member 80 is disposed in the first transporting path 65 between the second pair of rollers 59 and the third pair of rollers 44. As shown in FIG. 2, the guide member 80 is disposed so as to oppose the path switching unit 41 on the downside of the path switching unit 41. As shown in FIG. 2, FIG. 4, FIG. 5, and FIG. 6, the guide member 80 includes a guide body 81, a plurality of ribs 82, and a spring 88 (an example of an urging member) such as a coil spring.

Figure 5A:
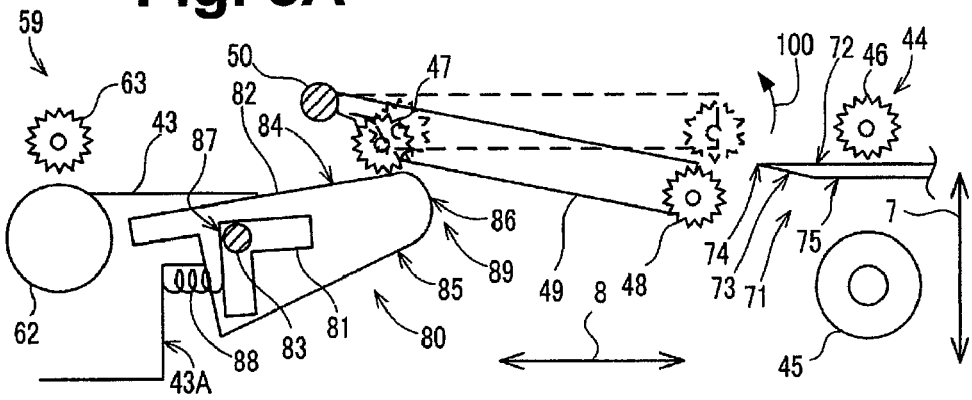
FIG. 5A is a vertical cross-sectional view diagrammatically showing the guide member and the media tray in a state in which the leading end of the media tray is in abutment with an auxiliary roller of a path switching unit.
Figure 5B:
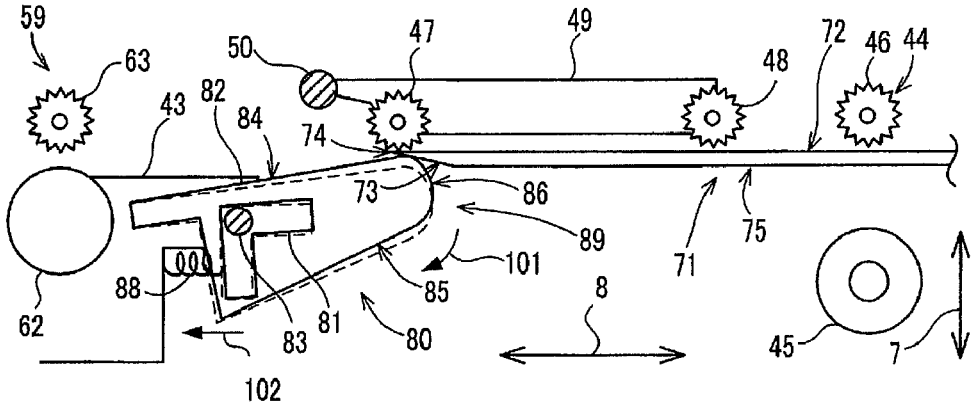
FIG. 5B is a vertical cross-sectional view diagrammatically showing the guide member and the media tray in a state in which a leading end surface of the media tray is in abutment with a curved surface of a rib of the guide member.
Figure 5C:
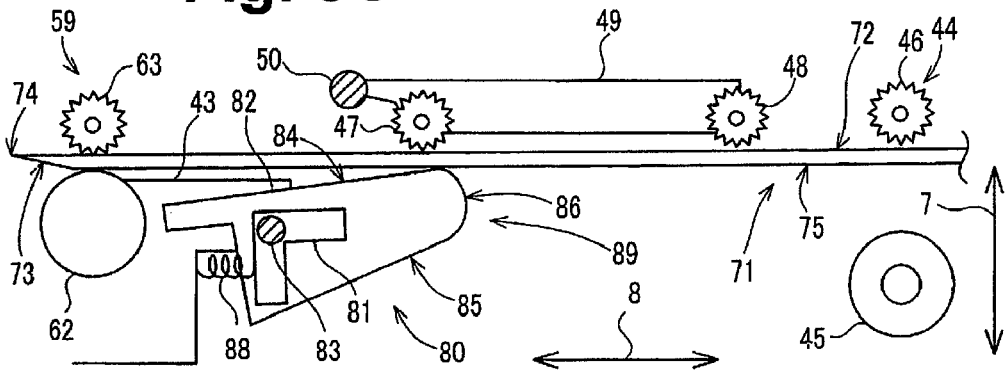
FIG. 5C is a vertical cross-sectional view diagrammatically showing the guide member and the media tray in a state in which the media tray is nipped by a second pair of rollers.
Figure 6:
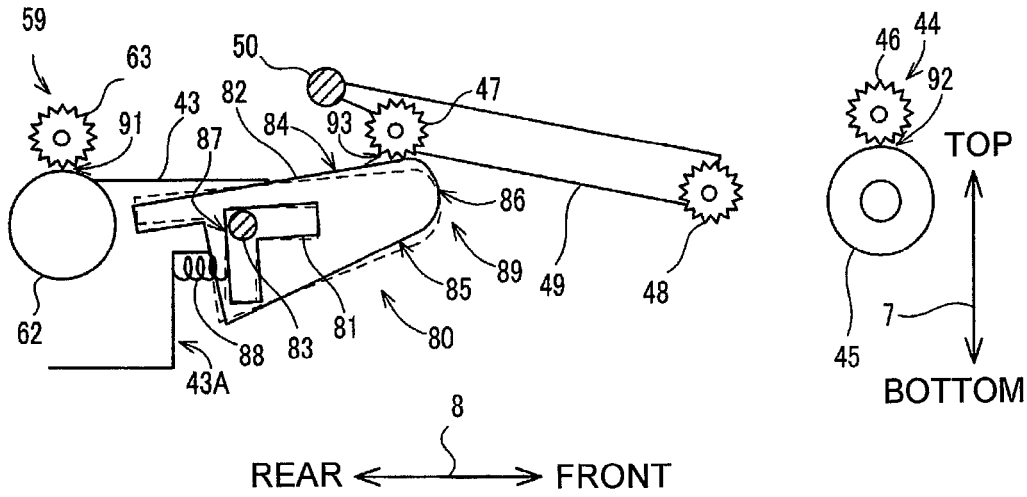
FIG. 6 is a vertical cross-sectional view diagrammatically showing the guide member and the path switching unit.

As shown in FIG. 2, FIG. 5, and FIG. 6, a supporting shaft 83 extending in the direction vertical to the paper plane (the lateral direction 9 in FIG. 1) is disposed at a position proximity to a front end of the supporting member 43, that is, on the side of the guide member 80 proximity to the second pair of rollers 59. The supporting shaft 83 is rotatably supported by the supporting member 43. The guide member 80 extends forward and obliquely upward from the supporting shaft 83 in the direction of transport. The guide body 81 of the guide member 80 is rotatably supported by the supporting shaft 83. In other words, the guide member 80 is rotatably supported by the supporting member 43 on the side proximity to the second pair of rollers 59.

Figure 4:
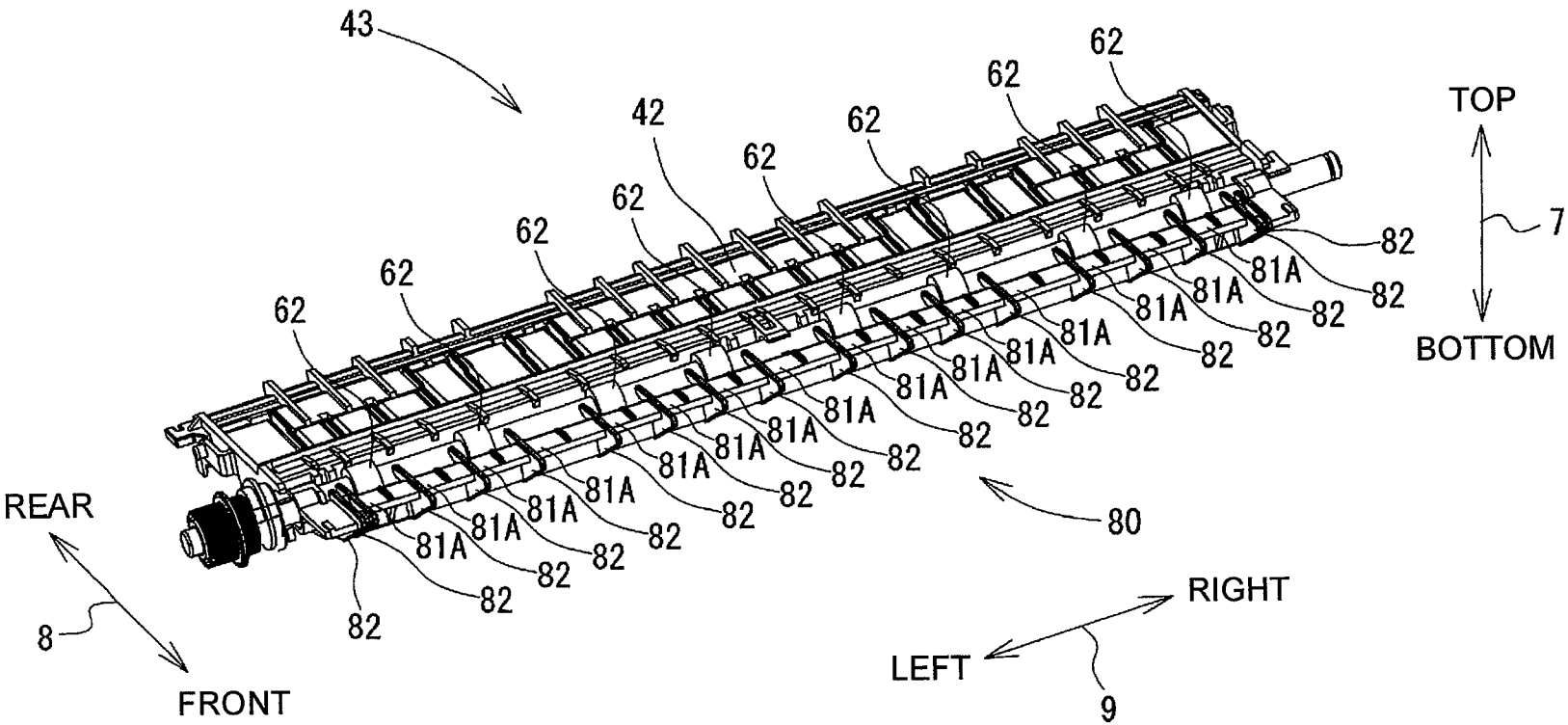
FIG. 4 is an appearance perspective view of a platen and a guide member.

As shown in FIG. 4, the ribs 82 have a thin shape and the length in the fore-and-aft direction 8 and the vertical direction 7 are longer than the length in the lateral direction 9. The ribs 82 are attached to the guide body 81. More specifically, the plurality of the ribs 82 are attached to the guide body 81 at predetermined intervals in the lateral direction 9.

As shown in FIG. 5 and FIG. 6, the ribs 82 each include the upper surface 84 which constitutes an inclined surface directing forward and obliquely upward (an example of a guide portion), a lower surface 85 which constitutes an inclined surface directing forward and obliquely upward and being steeper than the upper surface 84, and a curved surface 86 at the distal end portion 89 (an example of a distal end portion) of the ribs 82 between the upper surface 84 and the lower surface 85.

As shown in FIG. 2, FIG. 5, and FIG. 6, the upper surface 84 is a guide surface on the lower side of the first transporting path 65. In other words, in the downstream side of the printing unit 24 in the direction of transport, the first transporting path 65 is divided by the outer guide member 18 and the upper surfaces 84 of the ribs 82. Accordingly, the guide member 80 can support the printing medium by the upper surface 84. The lower surface 85 serves as a guide surface of the second transporting path 67 on the upper side. In other words, the second transporting path 67 is divided by the lower inclined guide member 33 and the supporting member 43 on the meeting point 37 side, and is divided by the lower inclined guide member 33 and the lower surface 85 of the ribs 82 on the branched port 36 side.

As shown in FIG. 5A, the coil spring 88 is attached to the guide member 80. The coil spring 88 is attached at one end thereof to a front end surface 43A of the supporting member 43, and at the other end thereof to a rear end surface 87 of the guide body 81.

[Rotation of Guide Member 80]

As shown in FIG. 6, the guide member 80 can be rotated to the slanting position (which corresponds to a position shown by a solid line in FIG. 6) in which the distal end portion 89 on the side of the third pair of rollers 44 (an example of a supporting position 93, which also may be a downstream end of the support portion 84, supporting the printing medium at the distal end portion 89) is located higher than the nip position 91 where the second pair of rollers 59 nips the printing medium, and the distal end portion 89 (the supporting position 93) is located lower than the nip position 92 where the third pair of rollers 44 nips the printing medium, and a laying position (a position indicated by a broken line in FIG. 6) in which the distal end portion 89 (supporting position 93) has the same height as the nip position 91 where the second pair of rollers 59 nips the printing medium about the supporting shaft 83 on the side proximity to the second pair of rollers 59 as an axis. The guide member 80 is rotated toward the laying position by coming into abutment with the leading end surface 73 of the media tray 71 as described later.

The coil spring 88 is attached to the guide member 80 and the supporting member 43 so as to urge the guide member 80 toward the slanting position. More specifically, the coil spring 88 having a natural length is attached at one end to the supporting member 43, and at the other end to the guide member 80 in the slanting position. Accordingly, when the guide member 80 rotates from the slanting position to the laying position, the coil spring 88 is contracted. At this time, the coil spring 88 generates a resilient force in the expanded direction and urges the guide member 80 upward, that is, toward the slanting position.

When the path switching unit 41 is in the protruding position, the auxiliary roller 47 of the path switching unit 41 comes into abutment with the upper surfaces 84 of the ribs 82 of the guide member 80 or, alternatively, with an upper surface 81A (see FIG. 4) of the guide body 81 of the guide member 80. In this embodiment, the auxiliary roller 47 is in abutment with the upper surfaces 84 of the ribs 82.

[Image Printing on Printing Medium]

Referring now to FIG. 2 to FIG. 5, a procedure to insert the media tray 71 into the multifunctional peripheral 10 and print an image on the recording medium placed on the media tray 71 will be described.

When an instruction of image printing on the recording medium is issued by an instructing unit, not shown, the third transporting roller 45 is moved downward by a downward movement of the supporting member, not shown, as shown in FIG. 2 and FIG. 5A. Also, the supporting member 43 is moved downward. Accordingly, the pinch roller 61, the second transporting roller 62, the platen 42, and the guide member 80 are moved downward.

Then, as shown in FIG. 2, the media tray 71 is inserted in the direction indicated by the arrow 77, which is an opposite direction from the direction of transport, from the opening 13 (see FIG. 1) on the front side of the multifunctional peripheral 10 along the first transporting path 65 by a user of the multifunctional peripheral 10. At this time, the media tray 71 is inserted while being placed on the tray guide 76. The multifunctional peripheral 10 does not necessarily have to be provided with the tray guide 76. For example, the housing 14 of the multifunctional peripheral 10 is formed with a tray insertion port, which is an opening for inserting the media tray 71, and the media tray 71 is inserted while being placed on a bottom surface of the tray insertion port. In other words, the bottom surface of the tray insertion port of the multifunctional peripheral 10 serves as the tray guide 76. When the insertion of the media tray 71 is sensed by a sensor, not shown, the first transporting roller 60 and the second transporting roller 62 are driven in the reverse direction.

The path switching unit 41 is rotated upward as indicated by an arrow 100, and the position is changed from the protruding position (a position indicated by a solid line in FIG. 5A) to the retracting position (a position indicated by a broken line in FIG. 5A). The position change is achieved, for example, by transmission of drive force from the motor or the like to the path switching unit 41 upon issue of an image printing instruction to the printing media as a trigger. Alternatively, a configuration in which a projection (not shown) is provided on the tray guide 76 on a surface where the media tray 71 is to be placed, and the supporting shaft 50 of the path switching unit 41 rotates in conjunction with pressing of the projection is also applicable. In this configuration, when the media tray 71 is placed on the tray guide 76, the projection is pressed, so that the supporting shaft 50 rotates to change the position of the path switching unit 41.

In the process where the media tray 71 is inserted by the user, as shown in FIG. 5B, the leading end surface 73 of the media tray 71 comes into abutment with the upper surfaces 84 of the ribs 82 of the guide member 80. In this state, when the media tray 71 is inserted further by the user, the leading end surface 73 is slid with respect to the upper surfaces 84. Since the leading end surface 73 is inclined obliquely downward, the guide member 80 rotates downward along the leading end surface 73 as indicated by an arrow 101. In other words, the leading end portion having a shape shown in FIG. 3B of the media tray 71 comes into abutment with the guide member 80, so that the guide member 80 is rotated from the slanting position (a position indicted by a solid line in FIG. 5B) to the laying position (a position indicated by a broken line in FIG. 5B).

When the guide member 80 is rotated from the slanting position to the laying position, the coil spring 88 is contracted in the direction indicated by an arrow 102.

Subsequently, the media tray 71 is nipped by the second pair of rollers 59 as shown in FIG. 5C. Accordingly, the media tray 71 leaves a user's hand, and is transported by the second pair of rollers 59. The media tray 71 passes underside of the printing unit 24, and comes into abutment with the first pair of rollers 58 from the downstream side in the direction of transport of the printing paper. The media tray 71 nipped by the first pair of rollers 58 and the second pair of rollers 59 is transported further upstream side in the direction of transport of the printing paper.

Accordingly, the recording medium placed on the media tray 71 is positioned on the upstream side of the printing unit 24 in the direction of transport of the printing paper. Then, the direction of rotation of the respective rollers 60 and 62 is switched from the reverse direction to the normal direction. Accordingly, the media tray 71 is transported in the direction of transport of the printing paper, and the recording medium placed on the media tray 71 passes over the platen 42. Ink droplets are discharged from the printhead 38 onto the recording medium transported on the platen 42. Accordingly, an image is printed on the disk surface of the recording medium. Subsequently, the media tray 71 is discharged.

Advantages of the Embodiment

When the guide member 80 is in the slanting position, the distal end portion 89 of the guide member 80 is located upward of the nip position 91 where the second pair of rollers 59 nips the printing medium. Therefore, the leading end 74 of the media tray 71 transported in the first transporting path 65 between the third pair of rollers 44 and the second pair of rollers 59 may collide with the guide member 80. However, in the embodiment as described above, since the guide member 80 rotates to the laying position, collision of the leading end 74 of the media tray 71 with the guide member 80 can be prevented. In other words, insertion or transport of the media tray 71 are not hindered by the guide member 80, which is a member for supporting the media tray 71.

In the embodiment described above, the position change of the guide member 80 can be achieved only by rotating the supporting shaft 83. In other words, the position change of the guide member 80 can be achieved with a simple configuration.

In the embodiment described above, the guide member 80 is urged by the coil spring 88 toward the slanting position. Also, the upper surface 79 of the tray guide 76 is provided on the downside of the distal end side of the guide member 80 in the slanting position. Therefore, the leading end 74 of the media tray 71 which is inserted by being guided by the tray guide 76 comes into contact with the guide member 80. However, even when the media tray 71 and guide member 80 come into contact with each other, the guide member 80 is rotated toward the laying position by coming into abutment with the leading end surface 73 of the media tray 71, so that the hindrance of the transport of the media tray 71 by the guide member 80 is prevented. Since the media tray 71 is supported by the guide member 80 urged toward the slanting position, the transport of the media tray 71 is stabilized.

In the embodiment described above, the leading end surface 73 of the media tray 71 is inclined downward from the front end toward the rear end of the media tray 71, that is, has a tapered shape. Therefore, when the leading end surface 73 of the media tray 71 comes into abutment with the guide member 80, the guide member 80 can change the position smoothly from the slanting position to the laying position.

In the embodiment described above, the path switching unit 41 is pressed against the upper surface of the printing paper, and hence is rotated toward the retracting position. In other words, after the printing paper has passed through the path switching unit 41, the path switching unit 41 is no longer supported by the printing paper and hence is rotated to the protruding position. When rotating to the protruding position as described above, the path switching unit 41 may be broken by colliding with the guide member 80. However, since the guide member 80 is urged by the coil spring 88 in the embodiment described above, an impact caused by the collision can be alleviated. Accordingly, the probability of breakage of the path switching unit 41 is reduced.

In the embodiment described above, the image is printed by the printing unit 24 on the printing paper in a state in which the printing paper is pressed against the platen 42 supported by the supporting member 43. Therefore, the distance between the platen 42 and the printing unit 24, that is, the height of the platen 42 is required to have high degree of accuracy. In the embodiment described above, since the guide member 80 is supported by the supporting member 43 which supports the platen 42, the height of the guide member 80 can be maintained at the same high degree of accuracy as the platen 42. In the embodiment described above, the guide member 80 is moved downward integrally with the supporting member 43 when the media tray 71 is transported through the first transporting path 65. Accordingly, an amount of rotation of the guide member 80 from the slanting position to the laying position required for transporting the media tray 71 can be reduced.

Modification of the Embodiment

In the embodiment described above, a case in which the guide member 80 is urged toward the slanting position by the coil spring 88 and is rotated to the laying position by coming into abutment with the leading end surface 73 of the media tray 71 has been described.

However the guide member 80 may not have the coil spring 88. For example, a configuration in which the guide member 80 is coupled with a motor, not shown, and is rotated between the slanting position and the laying position by the rotation of the supporting shaft 83 on the basis of the transmission of the drive force from the motor is also applicable. In this case, the guide member 80 is arranged to be in the slanting position. When the insertion of the media tray 71 is sensed by a sensor, not shown, the motor is driven and the guide member 80 is rotated toward the laying position.

The position of the guide member 80 may be changed from the slanting position to the laying position by a method other than the rotation. For example, a configuration in which the guide member 80 is connected at a lower surface thereof with a coil spring (not shown), and is urged downward by a resilient force of the coil spring is also applicable. In this case, the guide member 80 moves downward by the abutment with the leading end surface 73 of the media tray 71. In other words, the guide member 80 moves in the vertical direction 7 instead of rotating. The guide member 80 may be configured to move in the vertical direction 7 by the transmission of the drive force from the motor.

What is claimed is:

1. An image printing apparatus comprising:

a printing unit configured to print an image on a printing medium;

a supporting member opposing the printing unit and having a supporting surface for supporting the printing medium;

a first pair of rollers configured to nip and transport the printing medium therebetween and disposed upstream of the printing unit in a transporting direction of the printing medium, the first pair of rollers including a first upper roller and a first lower roller, a rotation axis of the first upper roller being disposed downstream relative to a rotation axis of the first lower roller in the transporting direction, a height of a nip position of the first pair of rollers being greater than a height of the supporting surface of the supporting member;

a second pair of rollers configured to nip and transport the printing medium therebetween and disposed downstream of the printing unit in the transporting direction, a height of a nip position of the second pair of rollers being greater than a height of the supporting surface of the supporting member, the second pair of rollers being configured to contact with and separate from each other;

a third pair of rollers configured to nip and transport the printing medium therebetween and disposed downstream of the second pair of rollers in the transporting direction, a height of a nip position of the third pair of rollers is greater than the height of the nip position of the second pair of rollers, the third pair of rollers being configured to contact with and separate from each other; and a guide member disposed between the second pair of rollers and the third pair of rollers and including a guide portion which guides the printing medium transported by the second pair of rollers, the guide member being configured to pivot between (a) a slanting position in which a height of a downstream end of the guide portion is greater than the height of the nip position of the second pair of rollers and is smaller than the height of the nip position of the third pair of rollers and (b) a laying position in which the height of the downstream end of the guide portion is same with the height of the nip position of the second pair of rollers.

2. The image printing apparatus according to claim 1, further comprising an urging member configured to urge the guide member toward the slanting position.

3. The image printing apparatus according to claim 1, further comprising:

a tray which is capable of holding an object to be printed;

a tray guide disposed downstream of the third pair of rollers in the transporting direction of the printing medium and having a guide surface to guide the tray holding the object to be printed toward a position between the third pair of rollers, a height of the guide surface being smaller than the height of the downstream end of the guide portion; and wherein, when an leading end of the tray come into abutment with the guide member, the guide member is configured to be moved from the slanting position to the laying position.

4. The image printing apparatus according to claim 3, wherein a thickness of the tray increases gradually from the leading end.

5. The image printing apparatus according to claim 3, wherein, when the tray is separated away from guide member, the guide member is configured to be moved from the laying position to the slanting position.

6. The image printing apparatus according to claim 1, wherein the third pair of rollers is configured to switch back the printing medium, the image printing apparatus further comprises a return guide configured to guide the printing medium switched back by the third pair of rollers along a return path passing below the supporting member toward the first pair of rollers.

7. The image printing apparatus according to claim 1, wherein:

the second pair of rollers includes a second upper roller and a second lower roller configured to contact with and separate from the second upper roller;

the third pair of rollers includes a third upper roller and a third lower roller configured to contact with and separate from the third upper roller;

the supporting member is configured to move between (c) an upper position which allows the printing medium to pass between the supporting member and the printing unit and (d) a lower position which allows the tray to pass between the supporting member and the printing unit; and the supporting member is supporting the guide member such that the guide member is moved up and down in accordance with the supporting member while maintaining a posture thereof.

8. The image printing apparatus according to claim 1, wherein the object to be printed held by the tray is a compact disk.

* * * * *